US012799631B2

(12) United States Patent
Beachley

(10) Patent No.: US 12,799,631 B2
(45) Date of Patent: Nov. 17, 2026

(54) ASSEMBLY OF POLYMER STAPLE NANOFIBER YARN

(71) Applicant: Rowan University, Glassboro, NJ (US)

(72) Inventor: Vince Beachley, Medford Lakes, NJ (US)

(73) Assignee: Rowan University, Glassboro, NJ (US)

( * ) Notice: Subject to any disclaimer, the term of this patent is extended or adjusted under 35 U.S.C. 154(b) by 0 days.

(21) Appl. No.: 18/832,559

(22) PCT Filed: Jan. 25, 2023

(86) PCT No.: PCT/US2023/011538
§ 371 (c)(1),
(2) Date: Jul. 24, 2024

(87) PCT Pub. No.: WO2023/146913
PCT Pub. Date: Aug. 3, 2023

(65) Prior Publication Data
US 2025/0101634 A1 Mar. 27, 2025

Related U.S. Application Data

(60) Provisional application No. 63/302,740, filed on Jan. 25, 2022.

(51) Int. Cl.
*D01D 5/00* (2006.01)
*D01D 5/26* (2006.01)
*D01D 7/00* (2006.01)

(52) U.S. Cl.
CPC ..... *D01D 5/0076* (2013.01); *D01D 5/26* (2013.01); *D01D 7/00* (2013.01)

(58) Field of Classification Search
CPC ..... D01D 5/0076; D01D 5/26; D01D 5/12; D01D 7/00
See application file for complete search history.

(56) References Cited

U.S. PATENT DOCUMENTS 2,158,415 A 5/1939 Formhals
2,385,358 A 9/1945 Hanson
(Continued)

FOREIGN PATENT DOCUMENTS

WO WO-2015075658 A1 * 5/2015 ..... D02G 3/00

OTHER PUBLICATIONS

International Search Report & Written Opinion dated Apr. 18, 2023 for corresponding PCT International Patent Application No. PCT/US2023/011538.
(Continued)

*Primary Examiner* — Bao-Thieu L Nguyen
(74) *Attorney, Agent, or Firm* — Brunet & Co. Ltd.; Robert Brunet

(57) ABSTRACT

The present disclosure provides a system and method for producing nanofibers. The system includes an automated track system including a first track having a first face; and a second track having a second face facing the first face of the first track. The first track and the second track are positioned to define a proximal gap and a distal gap. The first track and the second track are adapted and configured to transfer a nanofiber coupled to the first face and the second face from the proximal gap to the distal gap. The system also includes a roving belt that is positioned to be partially disposed within the distal gap and is adapted and configured to decouple the nanofiber from the first face and the second face.

12 Claims, 14 Drawing Sheets

(56) References Cited

U.S. PATENT DOCUMENTS

| | | | | |
|---|---|---|---|---|
| 3,080,617 | A * | 3/1963 | Lytton | D01G 13/00 19/106 R |
| 3,445,896 | A * | 5/1969 | Chaikin | D01G 19/02 19/123 |
| 3,685,315 | A * | 8/1972 | Delberghe | D04B 9/14 66/9 B |
| 5,846,356 | A | 12/1998 | Vyakarnam et al. | |
| 7,828,539 | B1 | 11/2010 | Beachley et al. | |
| 2005/0198783 | A1* | 9/2005 | Rubenach | D01G 15/40 19/105 |
| 2006/0000070 | A1 | 1/2006 | Mooshammer | |
| 2009/0189318 | A1* | 7/2009 | Kim | D01D 5/0061 425/66 |
| 2012/0086154 | A1* | 4/2012 | Lennhoff | B29C 48/142 425/71 |
| 2016/0047063 | A1* | 2/2016 | Khandaker | D01D 5/0069 425/174.8 E |
| 2018/0282926 | A1* | 10/2018 | Frey | D01D 5/092 |
| 2018/0291527 | A1* | 10/2018 | Beachley | D04H 1/728 |
| 2019/0145022 | A1* | 5/2019 | Jao | D01D 10/0445 264/291 |
| 2024/0200234 | A1* | 6/2024 | Flamini | D01D 5/0076 |

OTHER PUBLICATIONS

Extended European Search Report dated Mar. 31, 2026 on European application 23747562.9.

* cited by examiner

A
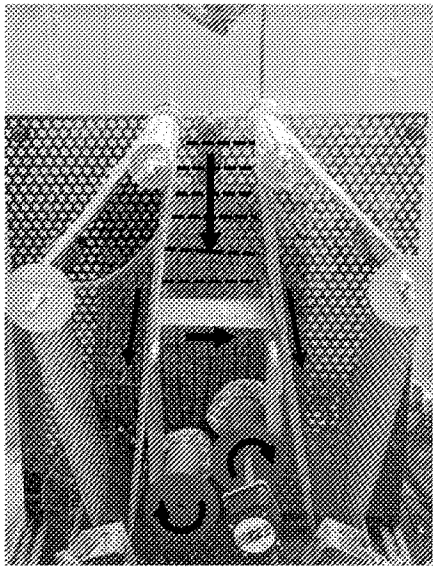
FIG. 10A
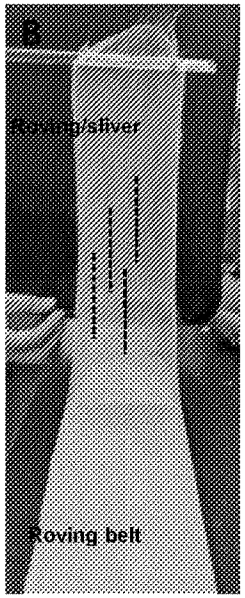
FIG. 10B
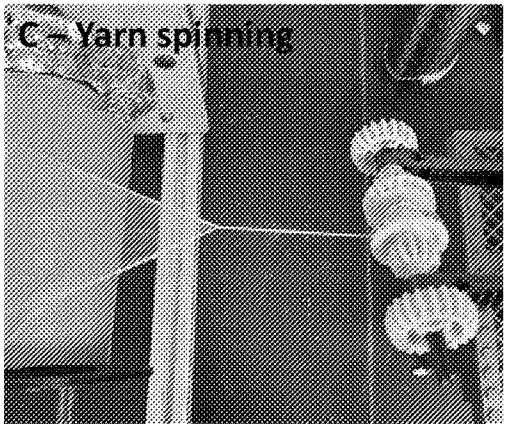
FIG. 10C
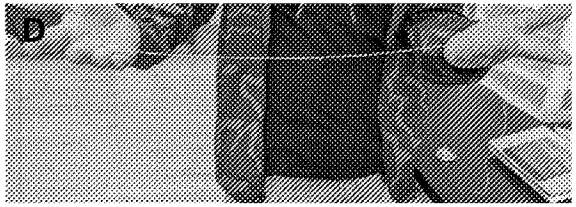
FIG. 10D
E
| Sample | Linear density (g/m) | Specific Strength (Nm/kg) |
|---|---|---|
| PCL yarn (100 cm, n=1) | 0.034 | $0.45e^5$ |
| PCL yarn segments (15 cm, n=5) | 0.025 ± 0.0046 | $0.74e^5 \pm 0.13e^5$ |
| PCL filament (DR1)* | 0.0031 | $1.96e^5$ |
FIG. 10E

ASSEMBLY OF POLYMER STAPLE NANOFIBER YARN

CROSS-REFERENCE TO RELATED APPLICATIONS

The present application is a 35 U.S.C. § 371 national phase application of International Application No. PCT/US2023/011538, filed Jan. 25, 2023, which claims the benefit of U.S. Provisional Patent Application No. 63/302,740, filed Jan. 25, 2022, all of which are incorporated herein by reference in their entireties.

STATEMENT REGARDING FEDERALLY SPONSORED RESEARCH OR DEVELOPMENT

This invention was made with government support under grant number 1653329 awarded by the National Science Foundation. The government has certain rights in the invention.

FIELD OF THE INVENTION

The present invention is directed to new systems and methods for preparing woven nanofiber yarns for use in sensors, electronics, high performance composite material, biotech and biomedical industry and manufacturing of nanomaterials.

BACKGROUND

When continuous filaments are not possible (e.g., wool, cotton, electrospun fibers, etc.) discrete length fibers can be interlocked into a continuous staple yarn. Prior to staple yarn spinning, fiber meshes can be sorted, carded, and combed to break up locks and clumps, and align disorganized fibers. Cotton carding with metal wire brushes is illustrated in FIG. 6A. These processes are not possible for fragile electrospun nanofibers that are tightly integrated into a collective structure. While electrospun nanofiber meshes look similar to natural fiber meshes on the micro-scale (e.g., see FIGS. 6B and 6D), they cannot be disassembled back into individual fiber components. For microfibers, once organized aligned bundles are obtained, they are steadily added and twisted together to form a continuous yarn with a stable self-locking structure. Little is known about how well polymer nano-yarns fit conventional models because organized staple nanofiber yarns are technically challenging to fabricate.

Given the importance of fiber properties such as surface area, and coefficient of friction to yarn properties, it is hypothesized that nano-yarns can exhibit unique behaviors.

Despite the inherent challenges, efforts have been made to produce electrospun nanofiber yarns. For example, continuous yarns have been spun from a nanofiber web collected on the surface of water. In another example, without liquids, continuous bundles of nanofibers have been formed by the attraction with two oppositely charged electrospinning jets that could be twisted into a yarn. In yet another example, a grounded needle and an AC current have been used to induce single electrospinning jets to self-bundle. In yet another example, dual rotating collectors have been used to twist aligned electrospun fibers into discontinuous bundles and later to wind long yarns. Though successful, all of these yarns were spun from fibers directly fed by an electrospun jet or by twisting a randomly oriented mesh. Thus, fiber length, feed rate, and uniformity can be difficult to measure and control. Direct collection from the electrospinning jet also precludes complete solvent evaporation and nanofiber post-processing before yarn assembly.

Staple yarn spinning in the traditional textile industry is a highly developed technology with a mechanistic understanding of the relationships between yarn structure and yarn strength. Polymer nanofiber materials are not compatible with traditional staple yarn manufacturing methods. Most attempts to produce electrospun yarns have been assembled from fibers directly intertwined from the electrospinning jet or from a randomly oriented nanofiber mesh floated on water. Under these conditions, it can be impossible to tightly control parameters such as nanofiber length, feed rate, and fiber organization. Thus, there is still little understanding of how conventional yarn structure-function relationships translate to the nanoscale.

SUMMARY

The present disclosure provides a system and method for producing nanofibers. The system includes an automated track system including a first track having a first face; and a second track having a second face facing the first face of the first track. The first track and the second track are positioned to define a proximal gap and a distal gap. The first track and the second track are adapted and configured to transfer a nanofiber coupled to the first face and the second face from the proximal gap to the distal gap. The system also includes a roving belt that is positioned to be partially disposed within the distal gap and is adapted and configured to decouple the nanofiber from the first face and the second face.

In another aspect, the present disclosure provides a method for producing nanofibers. The method includes: coupling a first end of a nanofiber to a first face of a first track and a second end of the nanofiber to a second face of a second track, wherein the first track and the second track are positioned to define a proximal gap and a distal gap, wherein the coupling occurs in the proximal gap; translating the first face and the second face such that the nanofiber travels from the distal to the proximal gap; disposing the nanofiber from the first face and the second face to a surface of a roving belt within the distal gap, such that a length of the nanofiber is in contact with the surface of the roving belt; and translating the roving belt such that the nanofiber travels out of the distal gap.

DEFINITIONS

The instant invention is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

The invention is best understood from the following detailed description when read in connection with the accompanying drawings. It is emphasized that, according to common practice, the various features of the drawing are not to scale. On the contrary, the dimensions of the various features are arbitrarily deformed or reduced for clarity. Included in the drawings are the following figures:

FIGS. 10A-10C illustrate a system for producing nanofibers, in accordance with exemplary embodiments of the present disclosure.

FIG. 10D illustrates PCL nanofiber yarn produced in accordance with exemplary embodiments of the present disclosure.

FIG. 10E illustrates a table of specific strength and linear density values.

DETAILED DESCRIPTION

Figure 1:
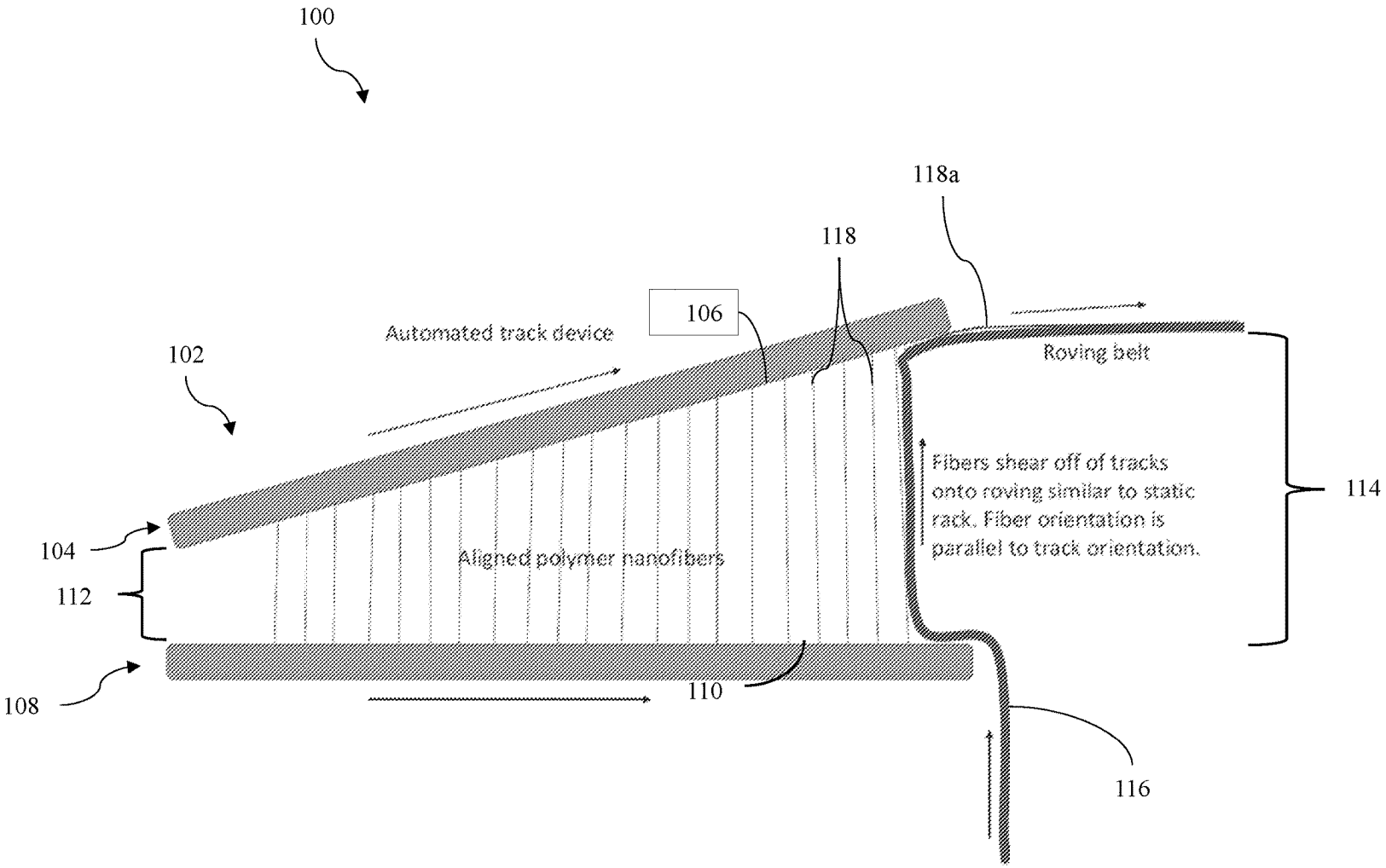
FIG. 1 illustrates a side view of a system for producing nanofibers, in accordance with exemplary embodiments of the present disclosure.

Described herein is a method to assemble stabilized, uniform length, aligned nanofibers into staple yarns in a highly controlled continuous process. The present disclosure provides a system and method to spin staple yarns from highly ordered electrospun polymer nanofibers with precise control over manufacturing parameters. In certain embodiments, the system and methods produce yarns from fixed-end, ordered, electrospun nanofiber arrays. Tight controls over nanofiber properties and spinning conditions can facilitate systematic investigation of fundamental textile manufacturing parameters (e.g., fiber twist, length, surface area, coefficient of friction, etc.). Certain systems and methods of the present disclosure can further knowledge about polymer nanofiber material response (e.g., in textile nanomanufacturing procedures) and develop a mechanistic understanding of yarn structure-strength relationships in the nanoscale.

In at least one aspect of the invention, automated tracks provide a continuous feed of aligned nanofiber arrays which are then spun to form staple yarns. In at least one embodiment, track designs can be integrated with a rotating leader that twists and winds. In at least one embodiment, the rotating leader is configured for automated track spinning from the fiber center. In at least one embodiment, the rotating leader is configured for automated track spinning from the fiber ends. In at least one embodiment, device designs will incorporate: (1) adjustable geometry of fiber contact with the spinning leader to allow for contact angles from 0-90° at any point from the middle to the end of fiber; (2) clean, consistent fiber end detachment from the tracks; and (3) adjustable track widths to accommodate a range of nanofiber lengths of at least 1-6 cm.

Those of ordinary skill in the art can appreciate that the present disclosure, among other uses has application, in tissue engineering scaffolds, lithium-ion batteries, supercapacitors, dye-sensitized solar cells, sensors, electronics, high performance composite material, catalysis and direct manufacturer/distributor of nanomaterial.

The utility of uniaxial fiber bundles lies in the ability to spin them into continuous staple yarns that are compatible with the textile industry. However, nanofibers cannot be processed into staple yarns using traditional techniques because of their small size and mechanical integrity. The present disclosure provides alternative systems and methods of staple yarn spinning that circumvents fiber pre-sorting and alignment processing by directly fabricating and delivering electrospun nanofibers as ordered aligned arrays. Highly organized, high strength staple yarns produced by systems and methods of the present disclosure allow electrospinning to become compatible with the textile industry and result in a multitude of polymer nano-fabric products.

Automated tracks can provide a continuous feed of aligned nanofiber arrays for spinning staple yarns. Several track geometries will be integrated with a twisting leader. Devices can be evaluated for a range of fiber-leader contact geometries, fiber lengths, and fiber detachment methods. PCL nanofibers with 250-1000 nm diameters will be assembled into 10-100 μm diameter yarns with twist angles from 10-70°. Assembled yarns can be characterized and compared to conventional microfiber models to ascertain the influence of the nanoscale on the structure-strength relationship.

Figure 7:
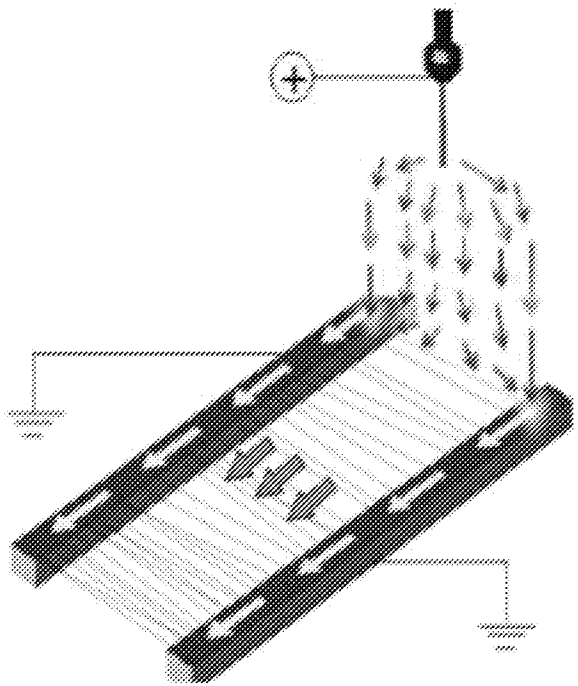
FIG. 7 illustrates automated track collection technologies which allow continuous collection of aligned individual nanofibers, in accordance with exemplary embodiments of the present disclosure.

Automated tracks can provide a continuous feed of aligned nanofiber arrays for spinning staple yarns in a fully integrated system. Horizontal tracks can replace the static collecting rack used in previous systems. A method to collect aligned electrospun nanofibers includes a nanofiber collecting device including two automated parallel tracks separated by an air gap (as illustrated in FIG. 7). Such a method and such a device are described in U.S. Pat. Nos. 8,580,181 and 7,828,539, which are incorporated herein by reference in their entirety as if fully set forth herein.

Figure 8A:
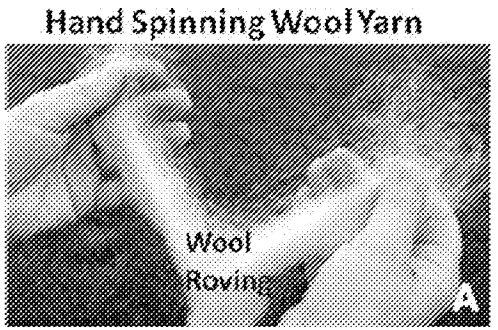
FIGS. 8A-8F illustrate various yarn spinning processes and techniques, in accordance with exemplary embodiments of the present disclosure.

A feed can take the place of the roving illustrated in FIG. 8A, which is used to spin conventional fibrous filaments such as wool, but cannot be formed with polymer nanofibers. Certain methods and systems of the present disclosure require continuous delivery and manipulation of fixed-end individual nanofibers. Track designs can be integrated with a rotating leader that twists and winds. Concepts for automated track spinning from the fiber center (FIG. 8C) and fiber ends (FIG. 8E) have been validated in the lab using manual techniques (as illustrated in FIGS. 8D and 8F). In accordance with certain exemplary embodiments of the present disclosure, device designs can incorporate: (1) adjustable geometry of fiber contact with the spinning leader to allow for contact angles (e.g., from) 0-90° at any point from the middle to the end of fiber; (2) clean, consistent fiber end detachment from the tracks; and/or (3) adjustable track widths to accommodate a range of nanofiber lengths (e.g., of at least 1-6 cm).

In at least one experiment, PCL nanofibers with diameters from 250-1000 nm can be electrospun and fed to a rotating yarn leader, in accordance with an exemplary embodiment of the present disclosure. Exemplary systems can be tested within the full range of fiber geometry limits described above. Nanofibers with packing densities from 10-100% can be fed at rates from 0-50 mm/s, for example. Leader rotation and translation rates can be optimized to form tightly wound yarns with target diameters, for example, from 10-100 μm and twist angles, for example, from 10-70°. The range of each parameter can be adjusted if the forces generated cause nanofiber breakage. In order to investigate the effect of coefficient of friction on yarn mechanical properties, yarns from blended PCL and poly (ethylene glycol) (PEG) nanofibers can be spun. Blended fibers can be electrospun from PCL solutions with PEG added, for example, at 0-30% weight in the common solvent HFIP. Manufactured yarns can be evaluated with a scanning electron microscope (SEM) to characterize overall yarn diameter, fiber count, nominal twist, variation of twist and irregularities. The mechanical properties of yarns can be evaluated for tensile strength and elongation at maximum force using a universal testing machine. The experimental values can be compared to expected values predicted by mechanistic models for conventional microfiber yarns. The design can provide a system where electrospinning, post-drawing, and staple yarn spinning are seamlessly integrated. Such a system and design can combine multiple devices and matching the rates of fiber collection and yarn feed by modifying device parameters. Multiple electrospinning jets can be used if the electrospinning rate is much lower than the required yarn feed rate.

Figure 2:
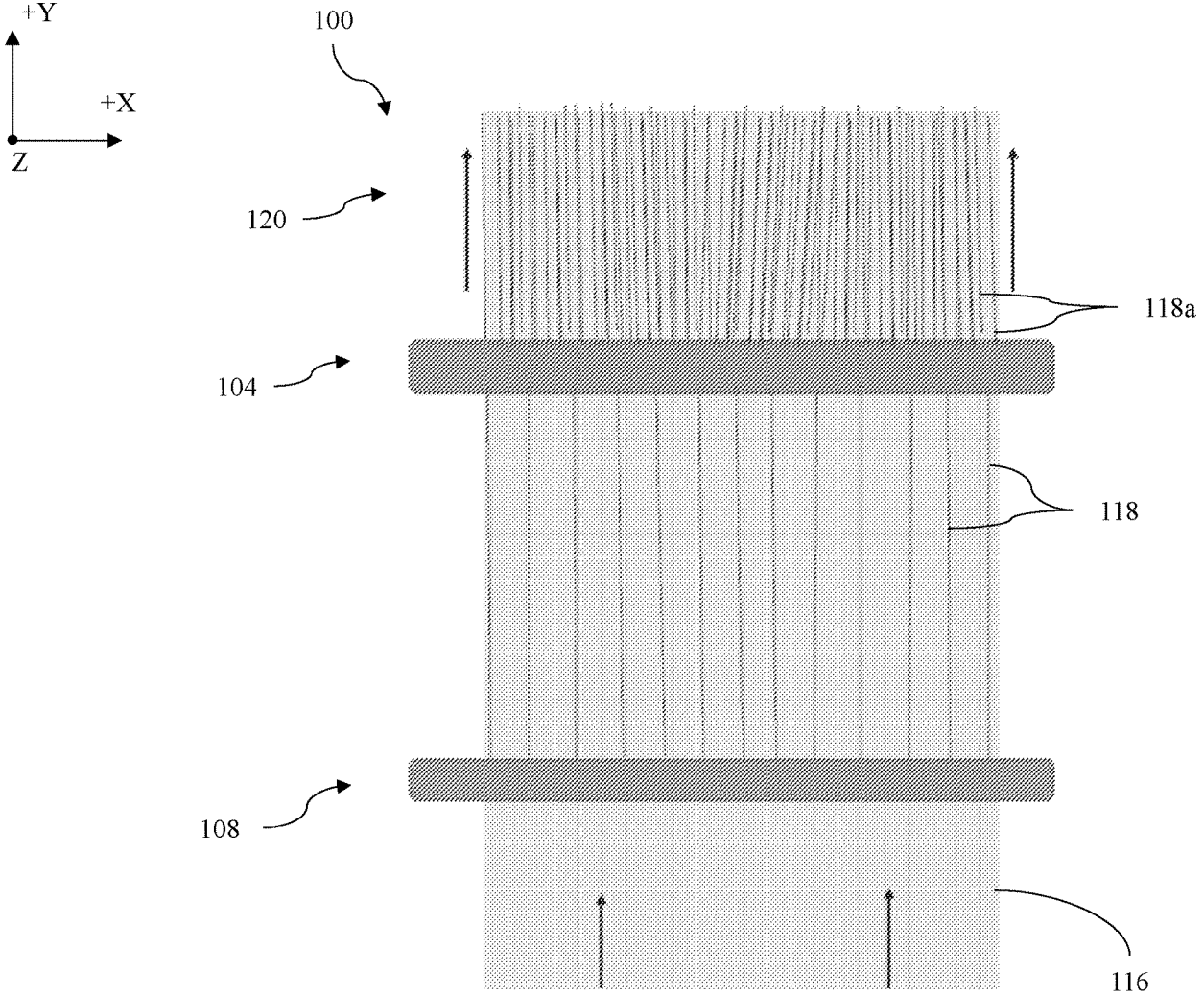
FIG. 2 illustrates a top view of a system for producing nanofibers, in accordance with exemplary embodiments of the present disclosure.
Figure 3:
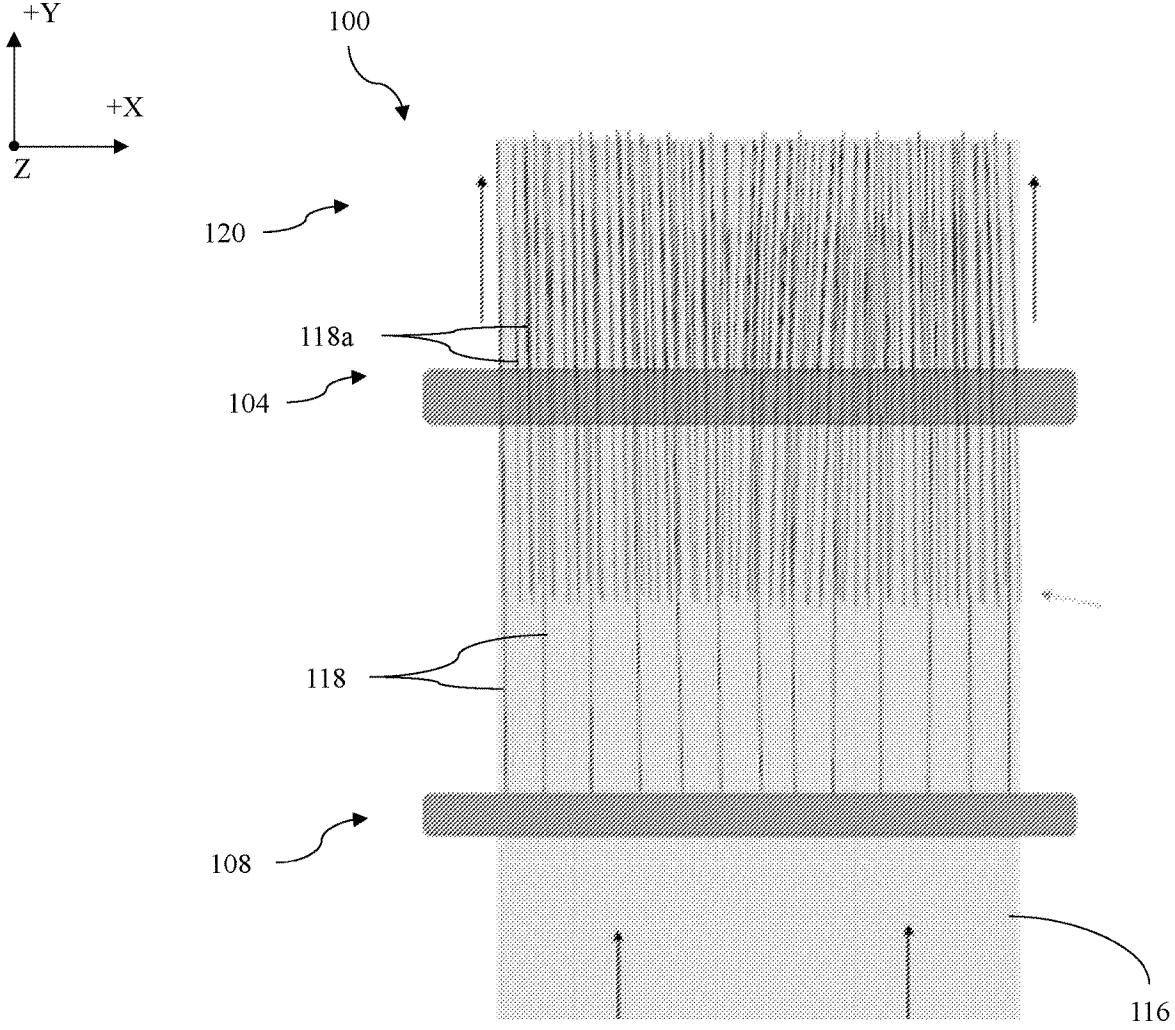
FIG. 3 illustrates a top view of a system for producing nanofibers, in accordance with exemplary embodiments of the present disclosure.

Exemplary embodiments of the present disclosure can be best described in connection with the drawings. FIGS. 1-3 illustrate an exemplary embodiment of a system 100 for producing nanofibers. Referring specifically to FIG. 1, a system 100 for producing nanofibers is illustrated in a side view. System 100 includes an automated track system 102. Automatic track system 102 includes a first track 104 having a first face 106. Automatic track system 102 also includes a second track 108 having a second face 110 facing the first face 106 of the first track 104. As illustrated, first track 104 and second track 108 are positioned to define a proximal gap 112 and a distal gap 114. First track 104 and second track 108 are adapted and configured to transfer a nanofiber 118 coupled to first face 106 and second face 110 from proximal gap 112 to distal gap 114. The arrows adjacent to first track 104 and second track 108 illustrate the direction of travel of each of the plurality of fibers 118.

System 100 also includes a roving belt 116. Roving belt 116 is positioned partially disposed within the distal gap. Roving belt 116 is adapted and configured to decouple nanofiber 118 from first face 106 and second face 110. For example, roving belt 116 is illustrated having decoupled a fiber 118*a* from a plurality of fibers 118 disposed between first track 104 and second track 108. Fiber 118*a* can be decoupled by shearing off the tracks onto a roving belt (similar to a static rack illustrated in FIG. 5). The adhesion or "stickiness" of fibers 118 and the surface properties (e.g., adherence, roughness, adhesion, or other material properties) of roving belt 116 in connection with the motion of fibers 118 and roving belt 116 can cause fibers 118 to shear off the automated track system 102 and onto roving belt 116. Fiber 118*a* can be decoupled by other mechanisms, such as fiber 118 decoupling due to: a tensile stress, heating (e.g., from a laser or another heat source), a chemical decoupling (e.g., curing), among mechanisms.

Referring now to FIG. 2, a top view of system 100 is illustrated. Automated track system 102 is illustrated substantially oriented perpendicular to the X-Y plane (i.e., along the Z-direction). Similarly, the direction of fiber travel is along the Z-direction. As illustrated, fibers 118 are placed in an aligned non-woven mesh 120 on top of roving belt 116. The adherence of roving belt 116 is configured such that fiber mesh can be removed.

Referring now to FIG. 3, a top view of system 100 is illustrated. FIG. 3 illustrates that the fiber overlap can be determined by the speed and/or increments of motion of roving belt 116 in relation to the fiber deposition rate at the collection area. The feed rate or discrete actuations of the automated track system 102 and/or roving belt can control the density of fibers 118 (i.e., the number of fibers per area) and layout of fibers.

Figure 4:
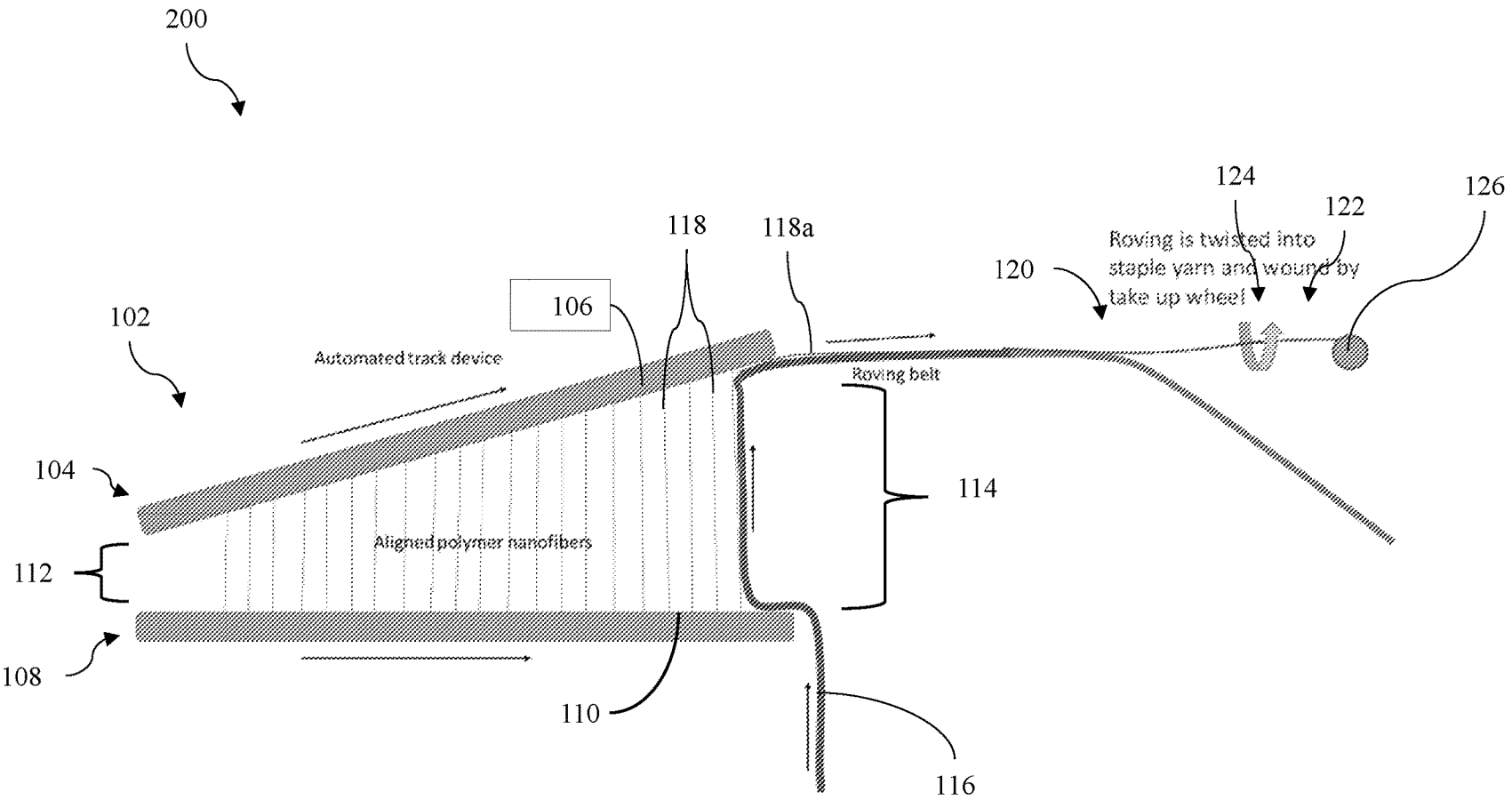
FIG. 4 illustrates a side view of a system for producing nanofibers, in accordance with exemplary embodiments of the present disclosure.

FIG. 4 illustrates a system 200 for producing nanofibers. System 200 is the same as system 100 described in connection with FIGS. 1-3, where like elements have like reference numerals, except system 200 includes a twisting mechanism 124 (for creating a staple yarn 122) and a take-up wheel 126. As illustrated, system 200 includes a twisting mechanism 124. Twisting mechanism 124 is a device used to twist mesh 120 into a staple yarn 122. Staple yarn 122 is subsequently wound around a take-up wheel 126 to collect staple yarn 122.

Figure 5A:
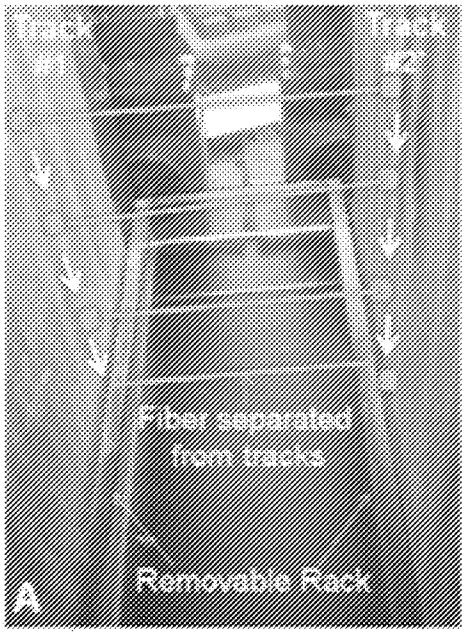
FIG. 5 illustrates a transferring of aligned nanofibers, in accordance with exemplary embodiments of the present disclosure.
Figure 5B:
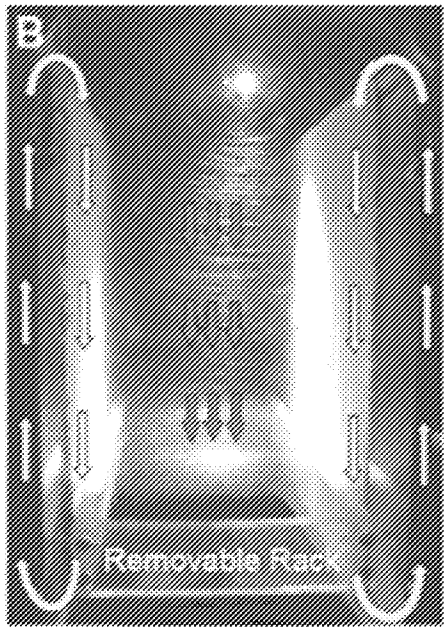
Figure 5C:
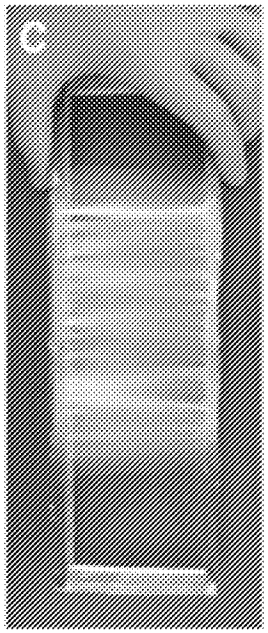

Referring now to FIGS. 5A-5C, a mechanism for transferring aligned nanofibers to a static rack is illustrated. FIG.

5A illustrates a path for a single nanofiber. As the nanofiber is pulled down by the track motion, the nanofiber is transferred to a rectangular rack where its ends are separated from the track by shear forces. The fiber direction is perpendicular to the direction of parallel track alignment. FIG. 5B illustrates a cross section of the device (illustrated in FIG. 5A) marked with arrows to show track motion (with white single arrows) and nanofiber motion (with darker grey triple arrows) when motors of the device are running. The light reflection allows visualization of the small diameter (e.g., 600 nm) nanofibers suspended inside of the device. FIG. 5C illustrates aligned nanofibers accumulated across the rack removed from the device.

Figures 6A, 6B, 6C, 6D:
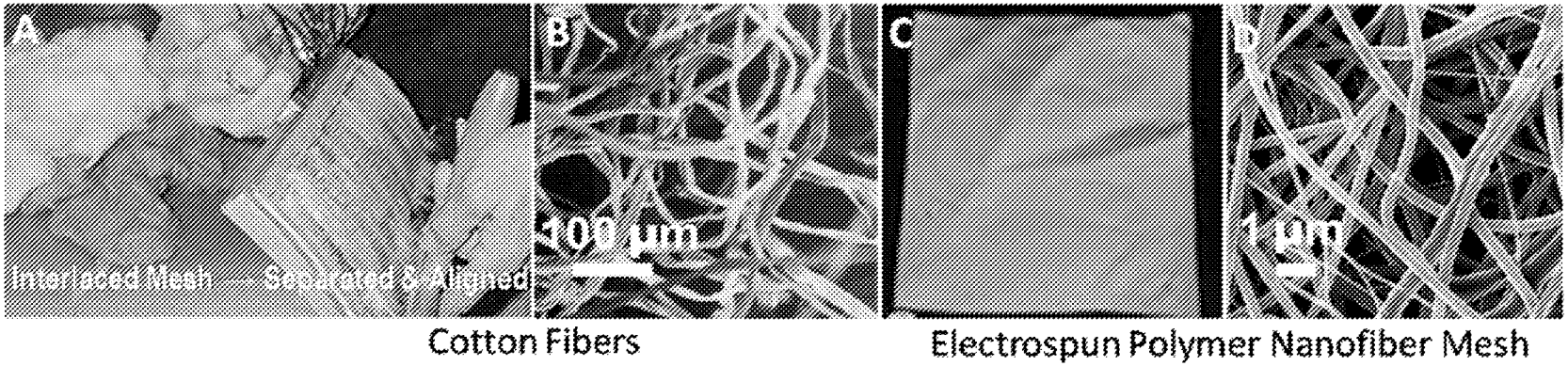
FIG. 6A illustrates cotton carding with metal wire brushes.
FIG. 6B illustrates an SEM image of cotton microfiber mesh.
FIG. 6C illustrates delicate electrospun nanofibers in a more tightly interlaced mesh.
FIG. 6D illustrates an SEM image of a polymer nanofiber mesh.

FIGS. 6A-6D illustrate various fiber processing techniques. As illustrated in FIG. 6A, cotton fibers can be carded with wire brushes to separate and align individual fibers from an interlaced mesh. FIG. 6B illustrates an SEM image of cotton microfiber mesh. FIG. 6C illustrates delicate electrospun nanofibers in a more tightly interlaced mesh, which can be difficult to separate (e.g., by carding with wire brushes or other methods). FIG. 6D illustrates an SEM image of a polymer nanofiber mesh.

FIG. 7 illustrates automated track collection technologies which allow continuous collection of aligned individual nanofibers.

Figure 8B:
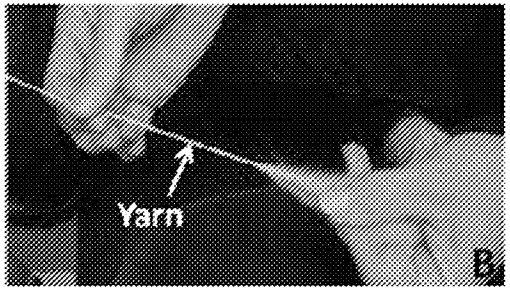
Figure 8C:
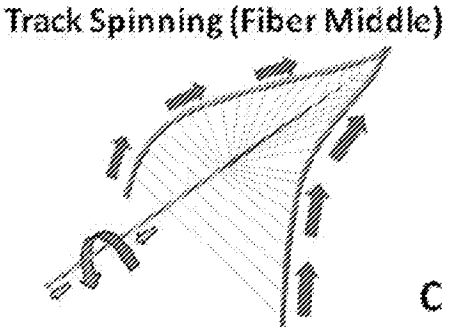
Figure 8D:
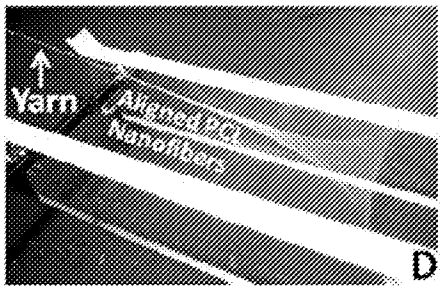
Figure 8E:
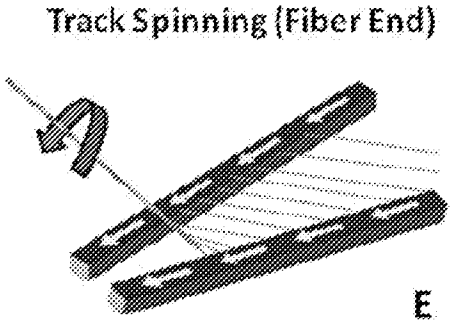
Figure 8F:
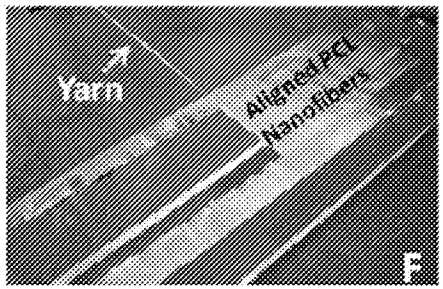

FIGS. 8A-8E illustrate various yarn spinning processes and techniques. FIG. 8A illustrates a wool roving contains loosely interlaced aligned fibers after combing & carding. FIG. 8B illustrates wool fibers from a roving being hand fed to a spinning leader to form a yarn. FIGS. 8C-8F illustrate individual polymer nanofibers with fixed ends being delivered in an aligned array without a roving. FIG. 8C illustrates a schematic of track spinning with using the middle of fibers. FIG. 8D illustrates a manual proof of concept (of the schematic from FIG. 8C) from a lab demonstration of spinning from the fiber middle. FIG. 8E illustrates a schematic of track spinning with using the end of fibers. FIG. 8F illustrates a manual proof of concept (of the schematic from FIG. 8E) from a lab demonstration of spinning from the fiber end.

Figure 9B:
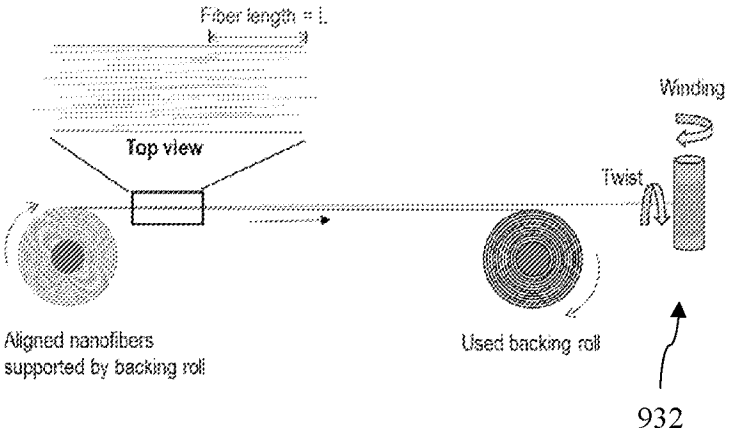
FIGS. 9A-9B illustrate a system for producing nanofibers, in accordance with exemplary embodiments of the present disclosure.
Figure 9A:
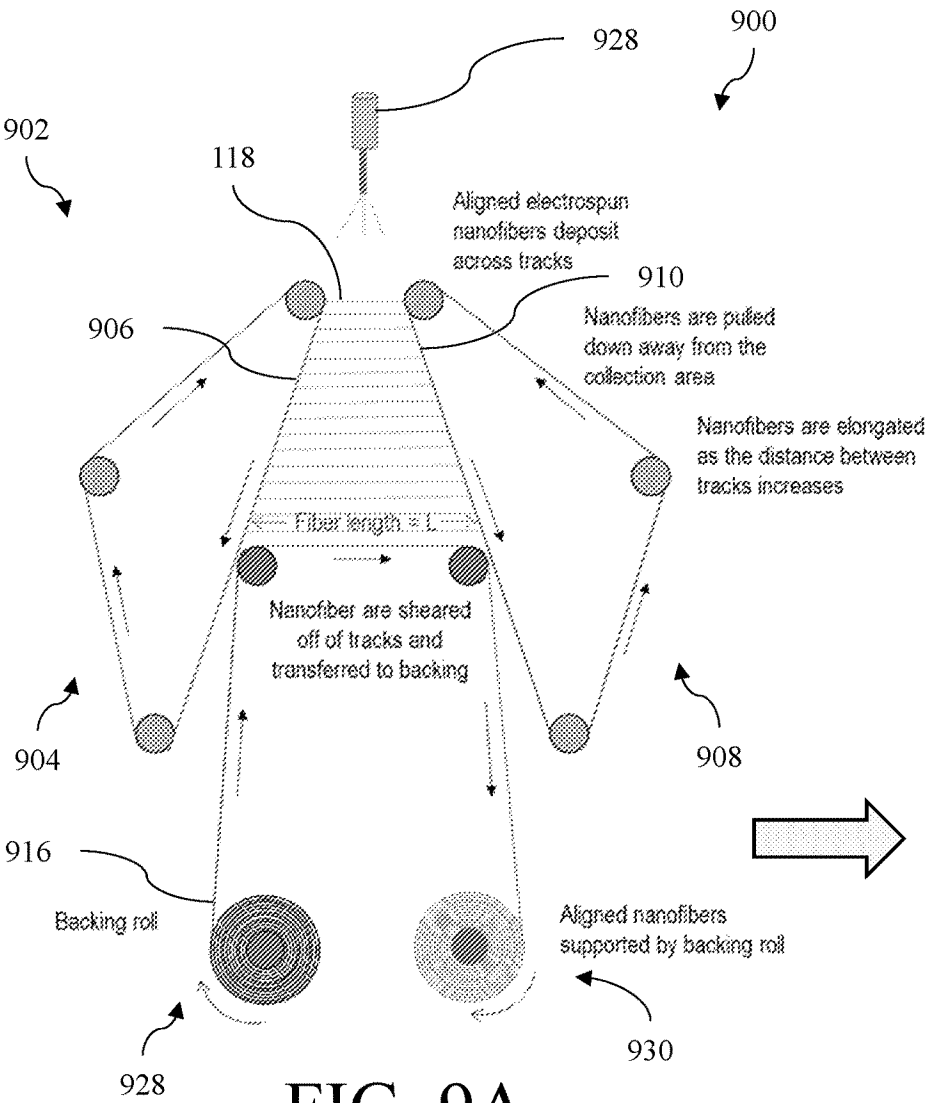

FIGS. 9A-9B illustrates a system 900 for producing nanofibers. System 900 is similar in many respects to systems 100 and 200 described in connection with FIGS. 1-4, where like elements have like reference numerals (or begin with a "9" in lieu of a "1" or "2"). System 900 includes an automated track system 902. Automated track system 902 includes a first track 904 having a first face 906. Automatic track system 902 also includes a second track 908 having a second face 910 facing the first face 906 of the first track 904. A plurality of fibers 118 are illustrated being deposited continuously on a belt 916 (e.g., a backing roll). Belt 916 is illustrated being continuously driven from a first backing roll 928 to a second backing roll 930. The second backing roll includes a plurality of aligned nanofibers. FIG. 9B illustrates a twisting and winding mechanism 932. As illustrated, the plurality of aligned nanofibers of second backing roll 930 and be unrolled and spooled using twisting and winding mechanism 932 (e.g., thereby creating a staple yarn).

FIGS. 10A-10D illustrates an embodiment of the present disclosure (similar in many respects to the embodiment illustrated in FIGS. 9A-9B). FIG. 10A illustrates electrospun roving/sliver fabrication, wherein the dashed lines represent a location of nanofibers, wherein the arrows represent a direction of nanofibers and tracks or a direction of roving belt/tape and roving belt/tape rolls. FIG. 10B illustrates roving/sliver being peeled from roving belt, wherein the dashed lines represent length and alignment of fibers in roving/sliver. FIG. 10C illustrates a yarn spinning apparatus. FIG. 10D illustrates an image of 100 cm long PCL nanofiber yarn (e.g., produced from the apparatus illustrated in FIGS. 10A-10C). FIG. 10E illustrates a table of specific strength and linear density values (e.g., based on 4600 fiber array[2] and assumption that the density of PCL is equal to 1.145 g/cm$^3$).

Figure 11:
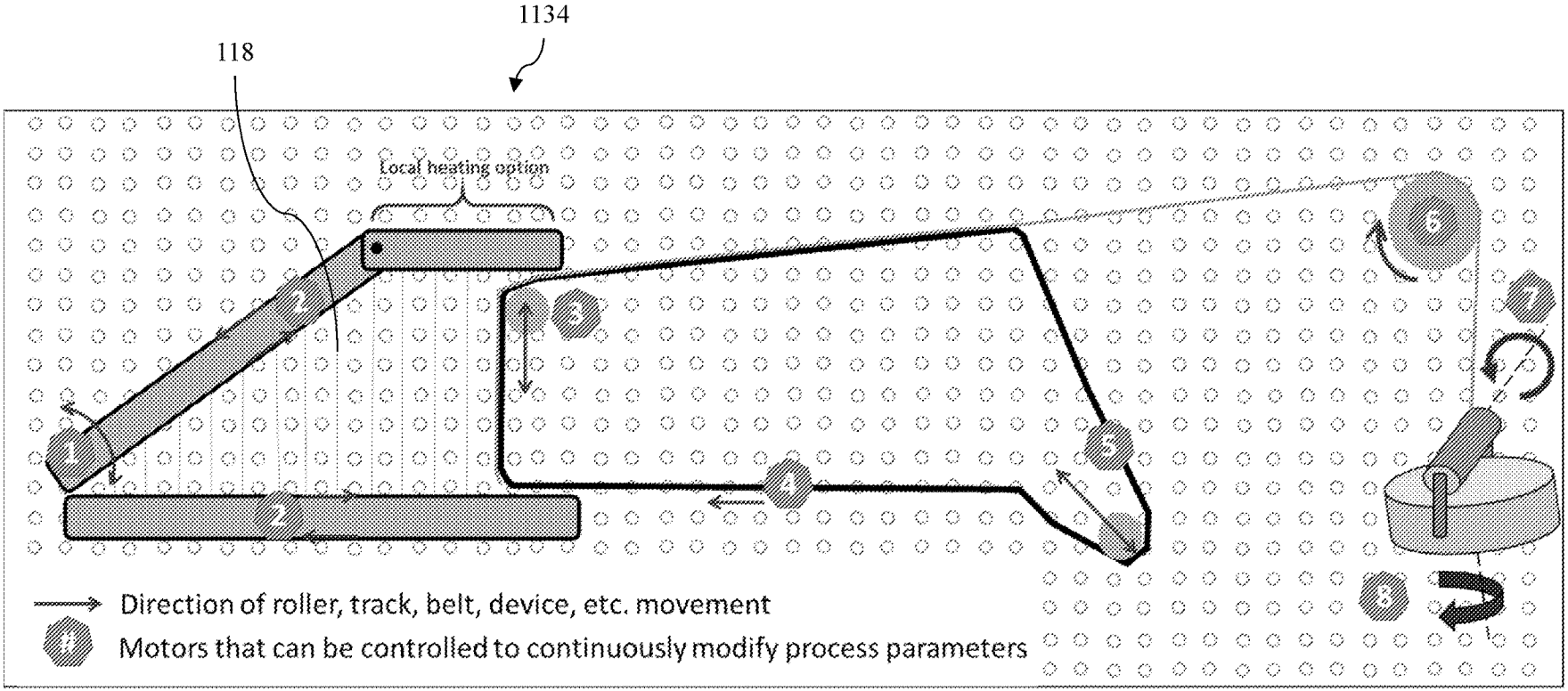
FIG. 11 illustrates a system for producing nanofibers, including trackspinning (contact drawing) fiber fabrication, roving/sliver assembly and yarn spinning, in accordance with exemplary embodiments of the present disclosure.

FIG. 11 illustrates trackspinning (contact drawing) fiber fabrication, roving/sliver assembly and yarn spinning with real time continuous modification of fiber and yarn fabrication parameters via motor controlled device geometry and rotating component, track and belt speeds. In the illustrated embodiment, a heating element 1134 can be used to heat and/or weaken the plurality of fibers 118.

Figure 12:
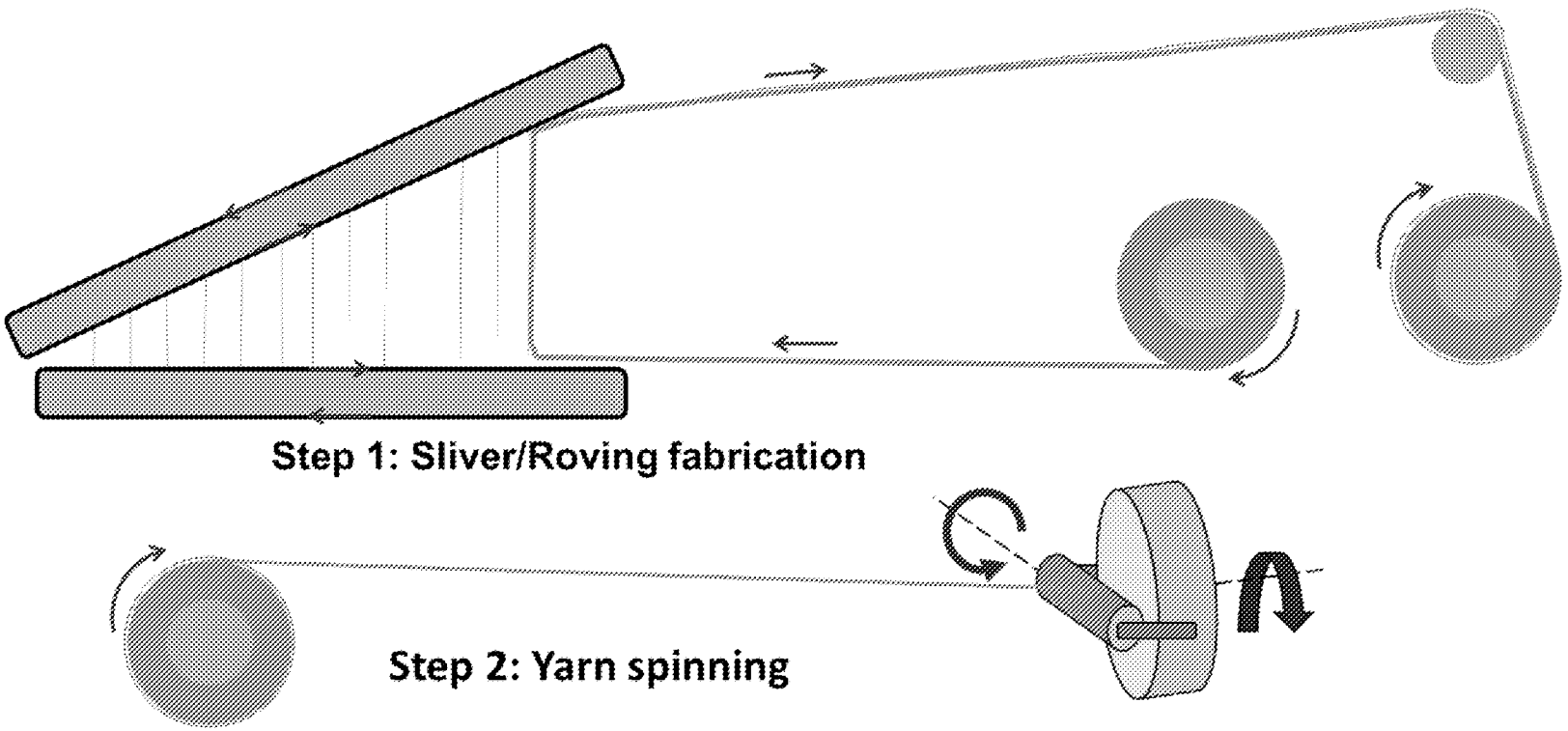
FIG. 12 illustrates a system of producing nanofibers and a method of using the same, in accordance with exemplary embodiments of the present disclosure.

FIG. 12 illustrates a system of producing nanofibers and a method of using the same. In a first step, a sliver and/or roving is fabricated. In a second step, the sliver and/or roving is used in a yarn spinning step.

Figure 13A:
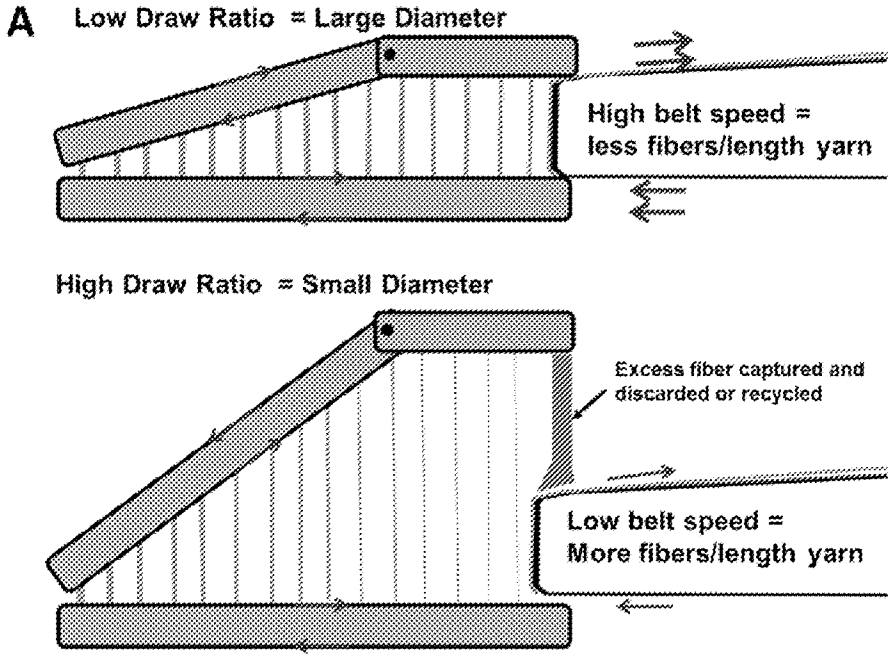
FIGS. 13A-13B illustrate a system of producing nanofibers including multivariable gradient rolls and yarns, in accordance with exemplary embodiments of the present disclosure.
Figure 13B:
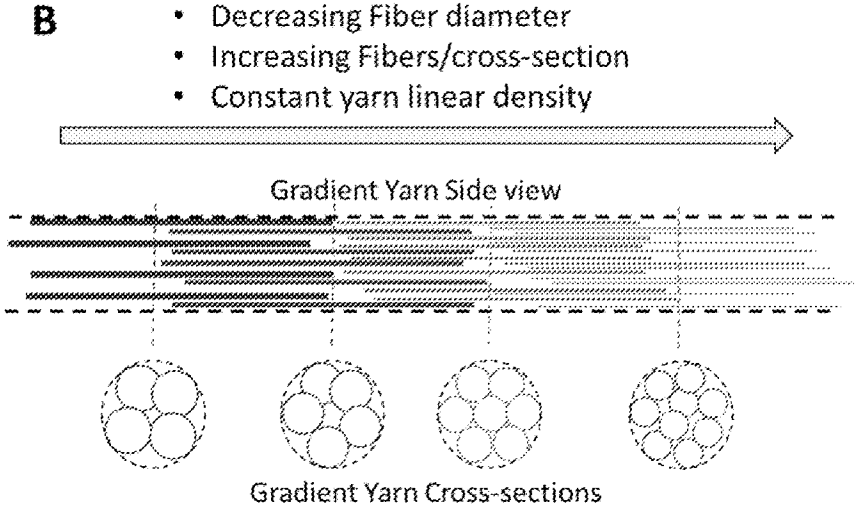

FIGS. 13A-13B illustrate multivariable gradient rolls and yarns. FIG. 13A illustrates that fiber diameter can be decreased by increasing draw ratio during the fiber fabrication step, while the number of fibers/cross-section in the roving/sliver can be increased by decreasing collection belt speed. FIG. 13B illustrates that the resulting material can have a consistent mass/length but a decreasing gradient of fiber diameter along its length.

Figures 14A, 14B, 14C, 14D, 14E, 14F, 14G:
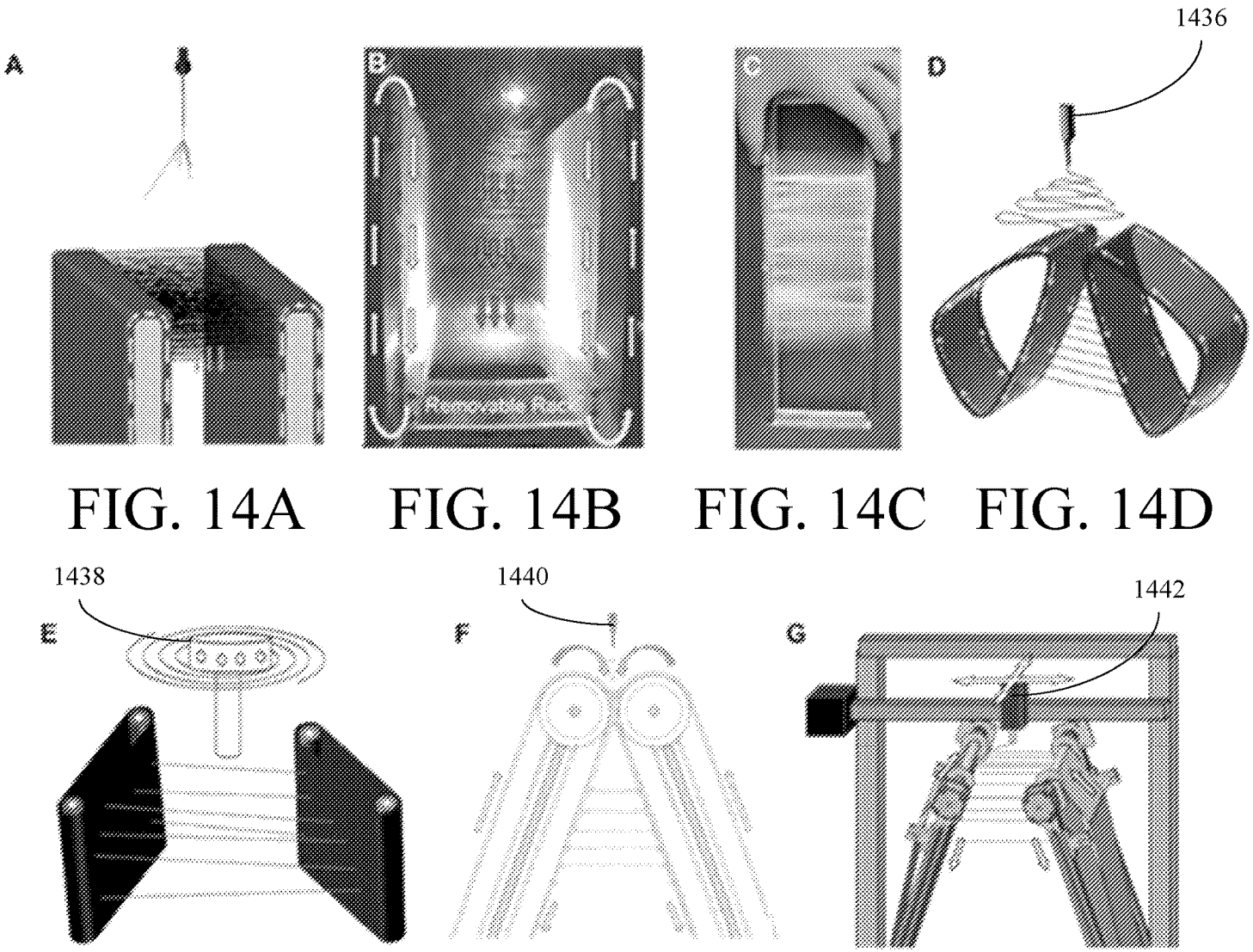
FIGS. 14A-14G illustrate various components that can be used in accordance with certain exemplary embodiments of the present disclosure.

FIGS. 14A-14G illustrate certain components that can be used with certain embodiments of the present disclosure. FIG. 14A illustrates automated tracks that can be used to collect aligned electrospun nanofiber arrays that can be sheared off of tracks (as illustrated in FIG. 14B) and onto a removable rack (as illustrated in FIG. 14C) to form an aligned fiber array. FIG. 14B illustrates fibers being deposited onto a removable rack. FIG. 14C illustrates a removeable rack. FIGS. 14D-14G illustrate angled automated tracks that can facilitate post-drawing of fibers (e.g., produced via processes including: electrospinning, centrifugal spinning, trackspinning (contact drawing) and/or 3D printing fibers via "stringing" effect). FIG. 14D illustrates electrospun fibers and a system producing the same. FIG. 14D is illustrated including an electrospinning nozzle 1436 for producing fibers in a pre-aligned state. FIG. 14E illustrates centrifugal spinning and a system producing the same. FIG. 14E is illustrated including a centrifugal spinning mechanism 1438 for producing fibers in a pre-aligned state. FIG. 14F illustrates track spun fibers (e.g., from contact drawing) and a system producing the same. FIG. 14F is illustrated including a nozzle 1440 for producing fibers in a pre-aligned state (e.g., a precursor can be deposited in a liquid-like state or a precured state prior to being drawn as fibers). FIG. 14G illustrates 3D printed fibers (e.g., via a "stringing" effect) and a system producing the same. FIG. 14G is illustrated including a 3D printing head 1442 for producing fibers in a pre-aligned state.

In certain embodiments, the present disclosure describes an approach to assemble staple yarns directly from a supply of discrete length aligned nanofibers delivered by an automated track. The present disclosure further provides a method of manufacturing ordered polymer nanofiber staple yarns. In certain embodiments, the methods of the disclosure allow for continuous manufacture of nanofiber staple yarns that can be compatible with higher order textile processing. In certain embodiments, the methods of the disclosure allow for roving from automated tracks. the methods of the disclosure allow for assembly of continuous nanofiber yarn from discrete length polymer nanofibers.

In certain embodiments, an intermediate step is added where aligned nanofibers are transferred to a continuous "roving".

In certain embodiments, the fixed ends of the fibers are removed from the track and incorporated into the roving such that the ends of the fibers are no longer fixed.

In certain embodiments, the roving is translated on a continuous conveyor belt with the fibers aligned in the direction of translation.

In certain embodiments, staple yarns are spun from the roving.

ENUMERATED EMBODIMENTS

The following enumerated embodiments are provided, the numbering of which is not to be construed as designating levels of importance.

Embodiment 1 provides a system for producing nanofibers, the system comprising: an automated track system including a first track having a first face, and a second track having a second face facing the first face of the first track, wherein the first track and the second track are positioned to define a proximal gap and a distal gap, and the first track and the second track are adapted and configured to transfer a nanofiber coupled to the first face and the second face from the proximal gap to the distal gap; and a roving belt that is positioned to be partially disposed within the distal gap and is adapted and configured to decouple the nanofiber from the first face and the second face.

Embodiment 2 provides the system of embodiment 1, wherein the roving belt is configured and adapted to transfer the nanofiber external to the distal gap.

Embodiment 3 provides the system of any one of embodiments 1-2, wherein the roving belt is configured and adapted to actuate at a speed independent of a speed of the first track and the second track.

Embodiment 4 provides the system of embodiment 3, wherein the speed of the roving belt is less than the speed of the first track and the second track.

Embodiment 5 provides the system of any one of embodiments 1-4, wherein the roving belt is adapted and configured to intermittently actuate.

Embodiment 6 provides the system of any one of embodiments 1-5, wherein the portion of the roving belt disposed in the distal gap is parallel to a length of the nanofiber.

Embodiment 7 provides the system of any one of embodiments 1-6, wherein the roving belt is adapted and configured to collect a second nanofiber, wherein a length of the second nanofiber at least partially overlaps a length of the nanofiber when coupled to the roving belt.

Embodiment 8 provides the system of any one of embodiments 1-7, wherein the roving belt is adapted and configured to transfer the nanofiber to a yarn spinner.

Embodiment 9 provides the system of any one of embodiments 1-8, wherein a portion of the roving belt disposed in the distal gap is perpendicular to a length of the nanofiber.

Embodiment 10 provides a method for producing nanofibers (e.g., using the system of any one of embodiments 1-9), comprising: coupling a first end of a nanofiber to a first face of a first track and a second end of the nanofiber to a second face of a second track, wherein the first track and the second track are positioned to define a proximal gap and a distal gap, wherein the coupling occurs in the proximal gap; translating the first face and the second face such that the nanofiber travels from the distal to the proximal gap; disposing the nanofiber from the first face and the second face to a surface of a roving belt within the distal gap, such that a length of the nanofiber is in contact with the surface of the roving belt; and translating the roving belt such that the nanofiber travels out of the distal gap.

Embodiment 11 provides the method of claim 10 wherein the disposing includes heating a portion of the nanofiber.

The invention claimed is:

1. A system for producing nanofibers, the system comprising:

an automated track system comprising:

a first track having a first face; and a second track having a second face facing the first face of the first track, wherein:

the first track and the second track are positioned to define a proximal gap and a distal gap; and the first track and the second track are adapted and configured to transfer a nanofiber coupled to the first face and the second face from the proximal gap to the distal gap; and a roving belt that has a flat planar surface that is positioned within the distal gap and is parallel to a length of the nanofiber, the roving belt being adapted and configured to decouple the nanofiber from the first face and the second face.

2. The system of claim 1, wherein the roving belt is configured and adapted to transfer the nanofiber external to the distal gap.

3. The system of claim 1, wherein the roving belt is configured and adapted to actuate at a speed independent of a speed of the first track and the second track.

4. The system of claim 3, wherein the speed of the roving belt is less than the speed of the first track and the second track.

5. The system of claim 1, wherein the roving belt is adapted and configured to intermittently actuate.

6. The system of claim 1, wherein the roving belt is adapted and configured to collect a second nanofiber, wherein a length of the second nanofiber at least partially overlaps a length of the nanofiber when coupled to the roving belt.

7. The system of claim 1, wherein the roving belt is adapted and configured to transfer the nanofiber to a yarn spinner.

8. The system of claim 1, wherein a portion of the roving belt disposed in the distal gap is perpendicular to a length of the nanofiber.

9. A method for producing nanofibers, comprising:

coupling a first end of a nanofiber to a first face of a first track and a second end of the nanofiber to a second face of a second track, wherein the first track and the second track are positioned to define a proximal gap and a distal, wherein the coupling occurs in the proximal gap;

translating the first face and the second face such that the nanofiber travels from the proximal gap to the distal gap;

disposing the nanofiber from the first face and the second face to a flat planar surface of a roving belt within the distal gap, such that the nanofiber has a length that is in contact with and parallel to the flat planar surface of the roving belt; and translating the roving belt such that the nanofiber travels out of the distal gap.

10. The method of claim 9, wherein the disposing includes heating a portion of the nanofiber.

11. The method of claim 9, wherein the distal gap is larger than the proximal gap.

12. The system of claim 1, wherein the distal gap is larger than the proximal gap.

* * * * *